US005348171A

United States Patent [19]

Haman et al.

[11] Patent Number: 5,348,171

[45] Date of Patent: Sep. 20, 1994

[54] REMOVABLE OUTRIGGER FOR MOBILE CRANE

[75] Inventors: Alan H. Haman, Versailles, Ky.; Timothy L. Wolles, Fairmont, Minn.

[73] Assignees: Link-Belt Construction Equip. Co., Ky.; Sumitomo Construction Machinery, Japan; a part interest

[21] Appl. No.: 986,795

[22] Filed: Dec. 8, 1992

[51] Int. Cl.[5] ..... B66C 23/78

[52] U.S. Cl. ..... 212/189

[58] Field of Search ..... 212/189, 175, 176, 177, 212/178, 179, 180, 181; 172/275

[56] References Cited

U.S. PATENT DOCUMENTS

| | | | |
|---|---|---|---|
| 3,836,012 | 9/1974 | Grider et al. . | |
| 3,840,125 | 10/1975 | Cozad | 212/189 |
| 4,454,952 | 6/1984 | McGhie . | |
| 4,664,411 | 5/1987 | Fix . | |

FOREIGN PATENT DOCUMENTS

| | | | |
|---|---|---|---|
| 1489716 | 6/1967 | France | 172/275 |
| 1096506 | 12/1967 | United Kingdom | 172/275 |

*Primary Examiner*—Michael S. Huppert
*Assistant Examiner*—Thomas J. Brahan
*Attorney, Agent, or Firm*—King and Schickli

[57] ABSTRACT

A removable outrigger unit is provided for a crane vehicle to provide weight reduction for over-the-road travel. Alignment cams allow rapid attachment/removal with respect to the vehicle frame. In a first or rear mounted embodiment, the outrigger has guide pins on spaced hangers that engage hooks on lugs mounted on the vehicle frame and rotary eccentric cams on the hangers that provide point alignment contact. A second or front mounted embodiment includes rotary eccentric and linear cams on the outrigger that contact side/bottom edge faces of cooperating dual lugs on the vehicle frame. The cams in both embodiments are preadjusted by bolts so that contact with the lugs occurs when corresponding lock pin receiving apertures are aligned. Double acting hydraulic cylinders on the outrigger move opposed lock pins through the aligned apertures and secure the outriggers to the frame. At least one support beam of the second embodiment includes pivotal beam extensions with an offset jacking cylinder. The beam extension with the cylinder is tilted to provide clearance to facilitate attachment and removal of the outrigger from under the vehicle frame. Further, a method for the self-powered tilting of the beam extension and removal of the outrigger is provided.

15 Claims, 11 Drawing Sheets

Fig. 3b
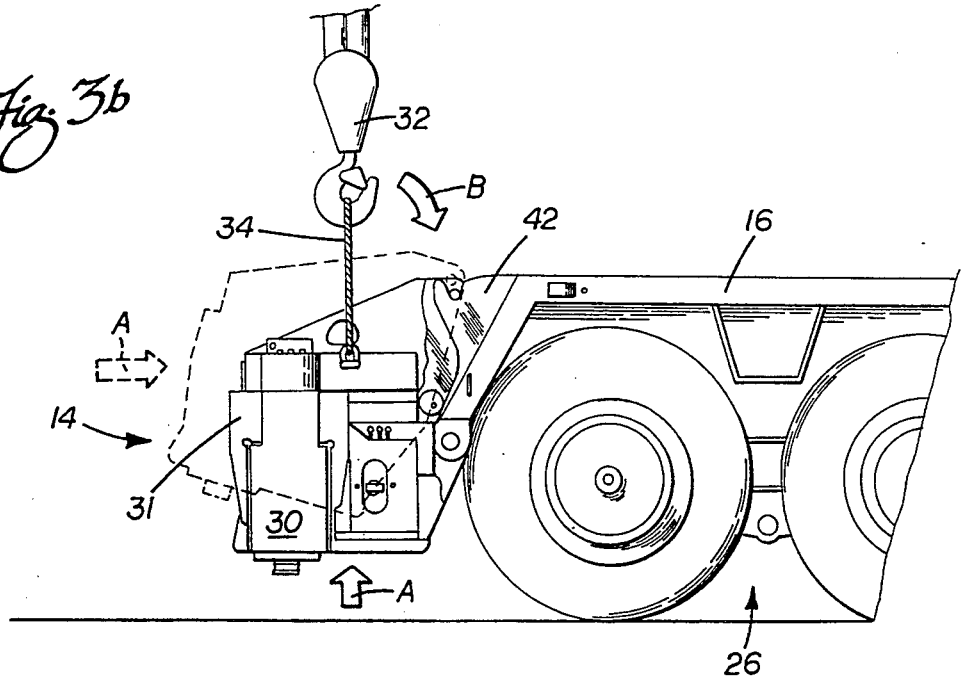
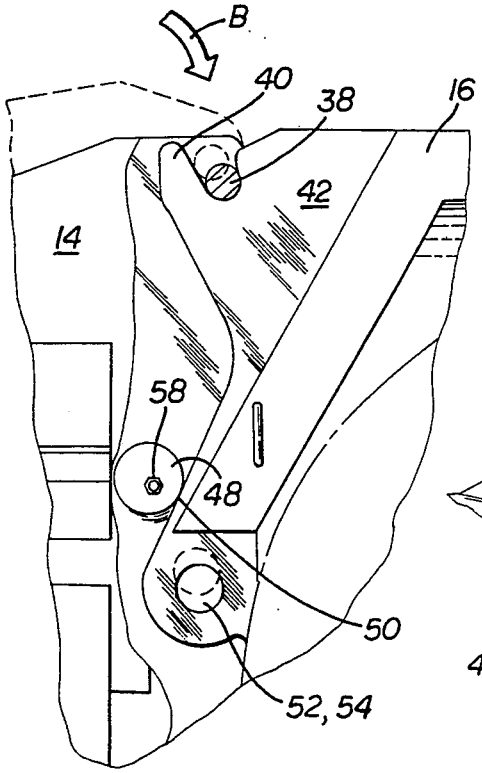
Fig. 3c
Fig. 3d
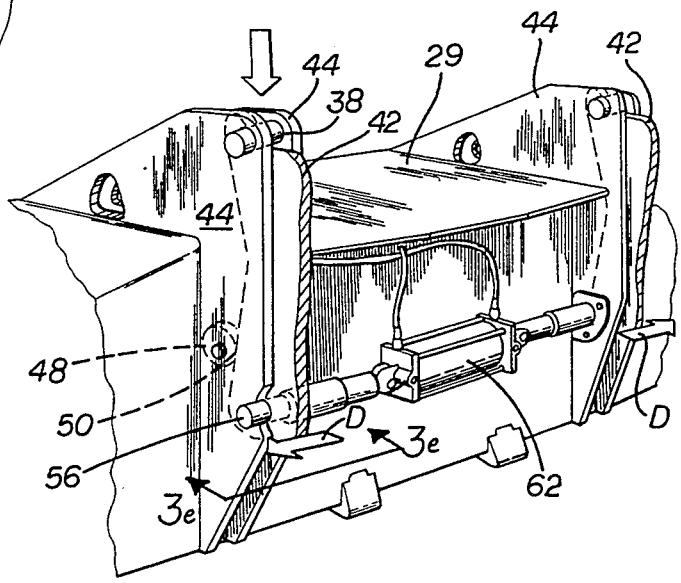

Fig. 5d
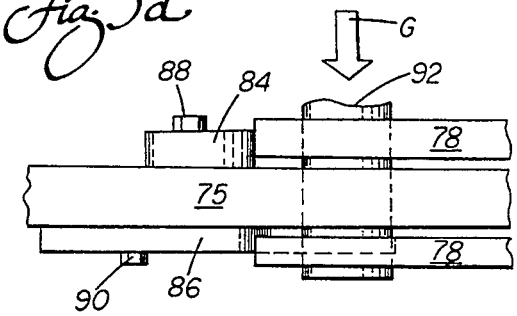
Fig. 5c
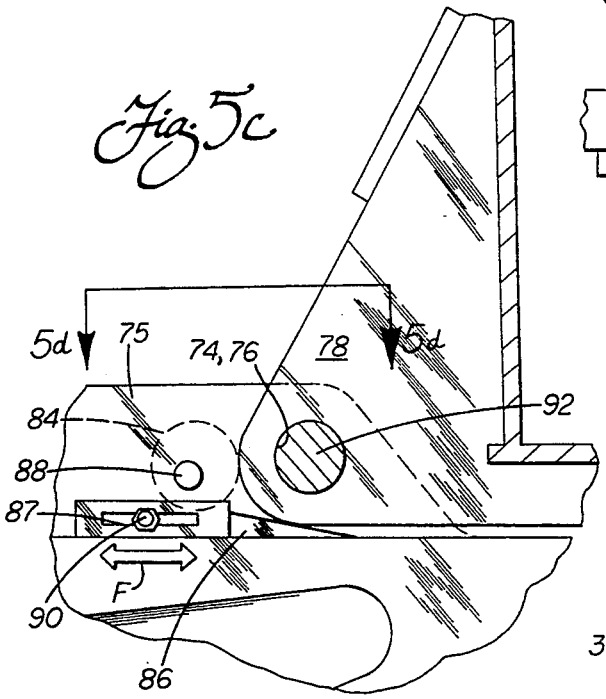
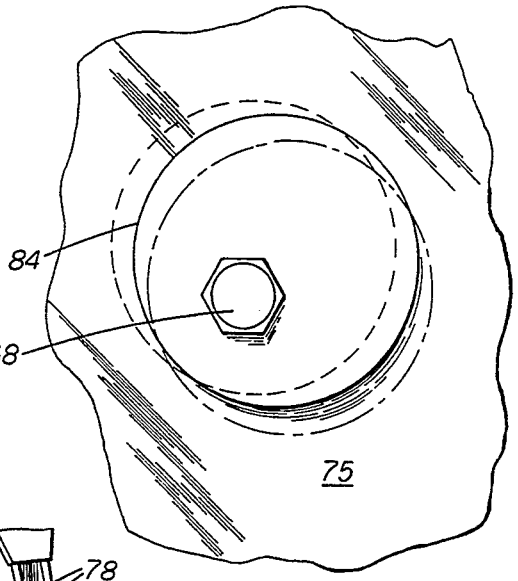
Fig. 6
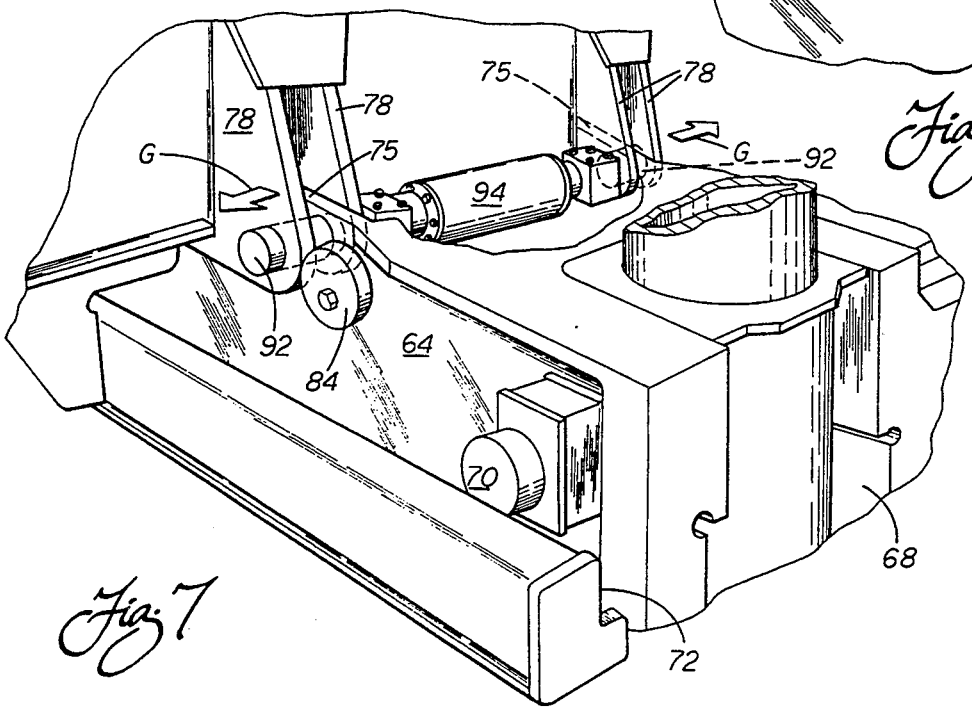
Fig. 7

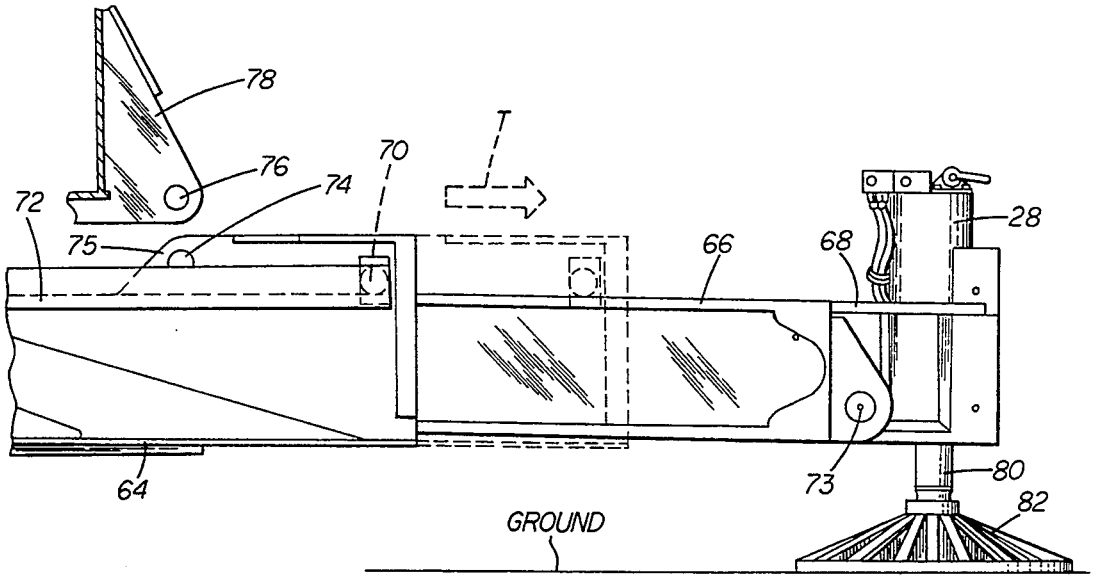
Fig. 16
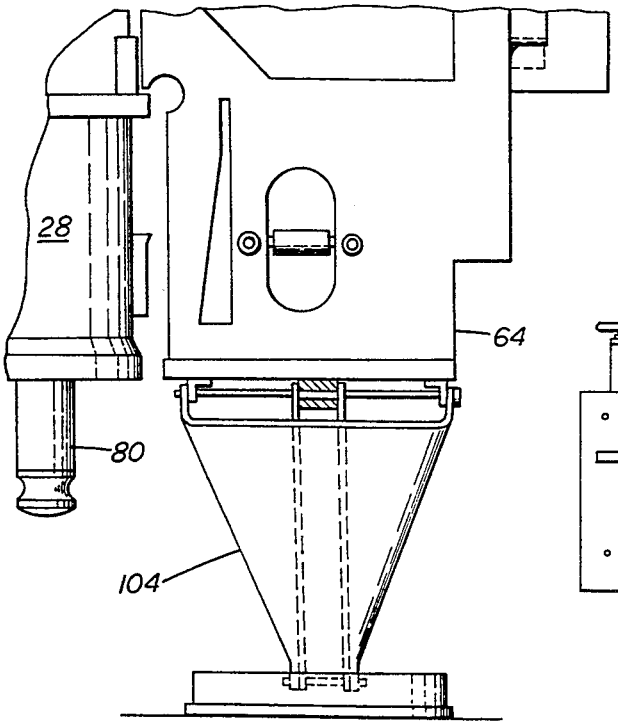
Fig. 13a
Fig. 13
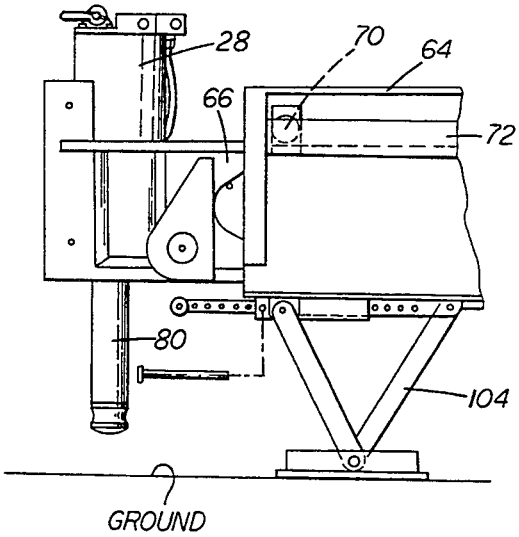

REMOVABLE OUTRIGGER FOR MOBILE CRANE

TECHNICAL FIELD

The present invention relates to removable outriggers for a mobile crane vehicle, and more particularly, to an improved system whereby the outriggers are fully mechanically aligned for ease of attachment, and are also fully self-powered for removal from under the vehicle.

BACKGROUND OF THE INVENTION

Outriggers for use with mobile cranes and other similar apparatus are necessary to stabilize the crane during lifting operations. Specifically, the outriggers include jacking cylinders with ground engaging pads mounted on opposed laterally extendable support beams. These beams are extended to position the jacking cylinders outwardly in spaced positions with respect to the vehicle chassis. The jacking cylinders are then extended to bring the pads into engagement with the ground, and raise the vehicle so that the wheel assemblies are lifted from the ground. The full weight of the crane is then supported through the outriggers. Advantageously, the wide spacing of the jacking cylinders and pads serves to provide the required side-to-side stability. Typically, a large mobile crane requires two outrigger units, one attached near the rear of the vehicle frame, the other towards the front. Accordingly, good fore/aft stability is also provided.

As the lifting capacity of the crane is increased, so too is the weight of the crane. Accordingly, the outrigger units must be fabricated for greater strength. This necessitates the utilization of stronger, heavier support beams, elongated frame and reinforcements. As a result, the weight of the outriggers also increases. This increase in outrigger weight, added to the already massive mobile crane weight, presents a well known problem. That is, the largest mobile cranes with outriggers can no longer comply with road weight restrictions in many jurisdictions.

As a result, it has become necessary on these larger cranes to use outriggers that are removable from the vehicle frame. These outrigger units are then transported over-the-road separately, usually on low-boy trailers. Because the front and rear outriggers can weigh up to 20,000 -22,000 lbs., and are generally unwieldy due to their relatively long length, it has proven difficult in the past to efficiently handle them. A key handling concern is the amount of turn-around time required for removal at one working site, and the reattachment at the next working site.

It is already known to construct both the front and rear outrigger units with an elongated box frame that can be securely attached to the vehicle frame and with internal hydraulic cylinders to extend and retract the support beams. Removable lock pins extend through mated apertures in the box and vehicle frames and this provides a significant advancement in the overall handling and attachment process. In fact, cranes with this type of removable outrigger units with removable lock pins have become commonplace in the construction equipment industry in recent years.

Despite the advantage provided by the outrigger units that are securely attached by lock pins, other advances in handling have been slow in coming. The considerable handling drawbacks coincident with the use of these removable outrigger units have had a significant adverse effect on sales of these units. The industry in general has heretofore simply found them to be very difficult to handle; i.e. it is too tedious and time consuming a task to both remove them from, and then reattach them to the vehicle.

Attachment is typically accomplished in three steps. First, using the cable and live mast of the crane or some separate, attendant crane, the outrigger unit is properly positioned with respect to the vehicle frame. This positioning is especially difficult when manipulating the front outrigger that is located under and attached to, the underside of the vehicle. The second step is to manually align apertures in the outrigger and vehicle frame that accommodate the securing lock pins. The large mass and inertia of the outrigger complicates the handling as this alignment takes place. Such a fine adjustment is particularly difficult to make under adverse weather conditions, such as high winds, rain and/or cold temperatures. In the final stages of alignment, the prior art outrigger units simply defy precise positioning. Inevitably the process requires a two or three man crew for manual intervention to push and pull on the unit for an inordinate amount of timer as it swings back and forth suspended by the crane.

Removal is accomplished by first disengaging the lock pins, and then removing the outrigger units from the vehicle frame, which is also difficult. Extracting the front outrigger unit is especially difficult because of its awkward location under the vehicle frame, and in most cases requires the attendant crane, as well as the manual intervention. Of course, the unwieldy nature of this outrigger unit especially exacerbates the handling problems during removal. It is not uncommon for the crew to finally have to drag the outrigger unit out from under the vehicle, especially if a separate, attendant crane is not available, subjecting the unit to possible damage.

A number of prior art assemblies, including those disclosed in U.S. Pat. Nos. 4,454,,952 to McGhie, 3,836,012 to Grider et al. and 4,664,411 to Fix, are representative of past efforts to improve the handling of outriggers during both the removal and reattachment phases. Specifically, it has been suggested to provide rollers or wheels on the outrigger units to allow rolling action to and from the attached position on the vehicle frame. This provides some improvement over having to drag the units. The McGhie '012 and Fix '411 patents disclose the concept of providing rollers that travel in corresponding guide rails on the vehicle frame.

Additionally, these prior art designs provide for the pivot mounting (or removal) of at least one of the jacking cylinders to provide clearance for the passage of the outrigger under the vehicle frame. Specifically, the Grider '012 and Fix '411 patents disclose arrangements wherein the jacking cylinder is pivotally mounted allowing it to be tilted into an angled or horizontal orientation for clearance. In both patents the jacking cylinders are directly mounted by brackets on the main outrigger beam, and in such a manner they must be manually tilted. As a result, this phase again requires at least a two man crew. In the Grider '012 patent, both the outrigger unit and jacking cylinders must be manually handled during the removal process.

Thus, despite the advances shown in these references, removal and attachment of outriggers remains a time consuming and difficult task. Attachment, in particular, presents a need for significant manual intervention. Specifically, the prior art procedure necessitates manually manipulating the outrigger unit to bring lock pin receiving apertures into alignment with corresponding apertures on the vehicle frame. Similarly, the cylinders must be manually manipulated before removal of the outrigger unit is possible. The prior art designs fail to provide any feasible approach to insure proper vertical and horizontal alignment of the attachment apertures, or to power tilt the cylinders. Advancements to accomplish these tasks would greatly simplify the procedure. By substantially eliminating this need for painstaking and time consuming manual intervention, a long felt need in handling of removable outrigger units for mobile cranes would be satisfied.

A particular need for an improved apparatus and related method for handling of outrigger units for mobile crane vehicles is thus identified. An improved approach for providing alignment of the units with respect to the vehicle frame is one of these needs, as is making the units so that they are self-powered for removal. Furthermore, a more self-contained unit allowing increased crane capacity, and other attendant features and advantages, are needed.

SUMMARY OF THE INVENTION

Accordingly, it is a primary object of the present invention to provide an improved means and related method of removal, as well as attaching an outrigger unit of mobile crane vehicle, and thereby overcoming the above described limitations and disadvantages of the prior art.

Another object of the invention is to provide a structural arrangement whereby an outrigger may be attached to the crane vehicle in an efficient manner without manual intervention. This is accomplished through the provision of integral adjustable guide elements at spaced points on the outriggers and vehicle frame that cause corresponding lock pin receiving apertures to be mechanically aligned.

It is yet another object of the present invention to provide a method of removal of a front outrigger unit from under a vehicle frame that does not require either an outside power source or manual intervention. This is accomplished by utilizing the cooperative structures of the outrigger unit itself to provide the motive force necessary.

It is another object to enhance the locking/unlocking arrangement of the unit by incorporating a hydraulic lock assembly on the outrigger unit to shift the pins, thus maximizing the total weight that can be removed for travel and thereby increasing the overall crane capacity.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, an improved removable outrigger unit that attaches to a crane vehicle chassis or frame is provided. The outrigger unit advantageously provides for efficient mechanical alignment of the cooperating lock apertures in the outrigger and vehicle frame. Accordingly, the outrigger unit is quickly and efficiently positioned so that attachment can proceed by actuation of the lock assemblies, all without the need for tedious and time consuming manual intervention.

The outrigger unit of the present invention may be constructed in accordance with two basic designs so as to be best suited for utilization at the front or rear of the vehicle frame. As reflected in the two preferred embodiments described herein, the broadest aspects of the invention apply to both. However, with regard to specific novel attributes of the front outrigger unit, it can be easily removed from under crane vehicle frame utilizing its own motive power. Advantageously, this also simplifies and speeds up the handling operation of this unit. Utilizing all the features of the invention, the crane vehicle can be prepared for over-the-road transport in record time and without the need for a crew of men or separate, attendant crane.

The first embodiment of the present invention is illustrated as a rear outrigger unit and includes the novel provisions for attaching to a vehicle frame. The outrigger unit is lifted and positioned so that fixed guide pins on spaced dual hangers fit onto open hooks on elongated lugs mounted on the vehicle frame. Once engaged, gravity pivots the outrigger about the guide pins until adjustable eccentric cams adjacent the bottom of the hangers make point contact with positioning stops formed by the vertical edge faces of the lugs, thereby inhibiting further pivotal movement. The cams are preadjusted as necessary so that lock pin receiving apertures of the hydraulic lock assembly on the outrigger unit align with corresponding lock pin receiving apertures in the spaced lugs on the vehicle frame.

The lock pins are then actuated to move into the aligned apertures to secure the rear outrigger to the vehicle frame. Specifically, a double acting hydraulic cylinder provided on the outrigger propels the lock pins outward, inserting them into the mating apertures. Accordingly, it should be appreciated that all alignment and pinning operations are completed mechanically in a quick and efficient manner. Advantageously, the elimination of manual intervention to complete these alignment procedures greatly enhances the utility of the crane. Generally speaking, a single operator can quickly and easily remove the rear outrigger unit and upon arrival at a new site reattach the unit in minimum time. The savings in time and personnel with just this rear unit is significant, but the savings is even greater in terms of the advantages of the front outrigger unit.

Thus, the second embodiment of the invention is a front outrigger unit, also with key alignment provisions for easing removal, as well as attachment to a vehicle frame. The first step to attach the front outrigger unit is to position it under the vehicle frame. Rollers on the unit engage tracks on the vehicle frame allowing it to be rolled from one side into position. Once fully positioned by rolling on the tracks to the proper position under the vehicle frame, jacking cylinders on the two end extensions of the opposed outrigger beams are actuated to first lift the outrigger unit up toward the vehicle frame.

Integral elements on the front outrigger unit and vehicle frame cooperate to engage each other and align the mating apertures of the lock assembly with apertures in dual mounting lugs as the unit is thus raised. Specifically, adjustable rotary eccentric cams on the outrigger unit make point contact with the side edge faces of the dual mounting lugs on the vehicle frame to effect horizontal alignment. Adjustable linear cams on the outrigger unit also make point contact with these same lugs, but along the bottom edge faces, for vertical alignment. Advantageously, the rotary eccentric cams and linear cams can be preadjusted to provide the exact positioning of the outrigger unit relative to the vehicle frame. As a result, the mating lock pin apertures in the outrigger and vehicle frame are automatically aligned and made ready for insertion of lock pins.

Thus, a pair of hydraulic lock assemblies, including the opposed lock pins carried by a double acting hydraulic cylinder, are mounted on the front outrigger unit at laterally separated positions. When actuated, the cylinders drive the lock pins through the aligned apertures securing the outrigger to the dual lugs on the frame. Once again, it should be appreciated that alignment and pinning are both completed mechanically, without manual manipulation, in a particularly time saving and efficient manner.

The front outrigger unit differs from the rear outrigger unit by also including provisions for positioning and removal from under the vehicle frame. In addition to the cooperating roller and rail arrangement discussed above, the pivotally mounted jacking cylinder on the extension of the outrigger support beam is used to advantage. The extension is mounted by a pivot offset from the axis of the cylinder and adjacent the lower end thereof. By tilting to a 45° position, it provides the necessary clearance for passage of the cylinder out from under the vehicle frame. The offset and lower end mounting of the extension advantageously contributes to the self-powered tilting action.

This embodiment also lends itself to a method for self-powered removal of the outrigger unit from under the vehicle frame. First, the unit is supported by the jacking cylinders and the locking pins securing the outrigger unit to the vehicle frame are retracted. This allows the unit to be suspended by the rollers on the rails once the cylinders are lowered. Next, as referred to briefly above, by use of the offset pivot and its own power, the jacking cylinder is tilted, locked in position and retracted for passage under the vehicle frame. After this, the opposite support beam is supported by an auxiliary jack stand on the box frame, and this jack cylinder is retracted. The support beam is extended outwardly to substantially the full extended position by the internal hydraulic beam cylinder. Then, the jacking cylinder on the extended beam is actuated to bring it into firm engagement with the ground. This fixes the position of this jacking cylinder and the outermost end of its outrigger support beam. The beam cylinder is then retracted causing the entire unit, including the outrigger box frame and the tilted jack cylinder, to move toward the fixed cylinder and partially out from under the vehicle frame. This procedure is then repeated as necessary (at least one more time) until the tilted cylinder finally clears the frame. In this manner the outrigger unit may be removed from beneath the frame, and advantageously, this is accomplished under its own power. From there, the lifting lugs on the outrigger unit are exposed so that a sling can be attached and the unit easily lifted by the crane and loaded onto a low-boy or similar flatbed trailer for over-the-road transport.

Still other objects of the present invention will become apparent to those skilled in this art from the following description wherein there is shown and described two preferred embodiments of this invention, simply by way of illustration of two of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

FIGS. 3*a*, 3*b* and 3*c* are cut away side or elevational views showing the sequence of moves required for the attachment of the rear outrigger unit, and illustrating particularly one dual hanger being lifted onto the cooperating hook on the elongated lug forming a part of the frame of the vehicle;

FIG. 3*d* is a cut away, perspective view of the rear outrigger unit attached to the hooks on the vehicle frame, showing the aligned locking apertures, and the double acting hydraulic cylinder as it actuates the lock pins;

FIG. 5*c* is a more detailed front view of the rotary eccentric cam and linear cam on a front outrigger unit and schematically illustrating sliding action adjustability of the linear cam;

FIG. 5*d* is a more detailed top view, corresponding to the showing in FIG. 5*c* and taken along the line 5*d*—5*d*, illustrating the eccentric cam and the linear cam on the front outrigger unit abutting the edge face of one of the dual mounting lugs and with the apertures aligned and the lock pin inserted;

FIG. 6 is a detailed side view showing pivotal movement of the eccentric cam about a locking bolt for adjustment;

FIG. 7 is a cut away perspective view of the front outrigger unit attached to the vehicle frame and illustrating the manner of insertion of the lock pins through the aligned apertures;

FIG. 13 is a front view of the right side of the front outrigger unit showing support by a manual jack stand allowing extension of the outrigger beam during the removal operation;

FIG. 13*a* is an end view of the outrigger box frame and beam, as shown in FIG. 13, showing further the construction of the manual jack stand;

FIG. 16 is a rear view of the right end of the front outrigger unit showing part of the two stroke, walking sequence of the removal method depicted in FIGS. 14 and 15.

DETAILED DESCRIPTION OF THE INVENTION

Figure 1:
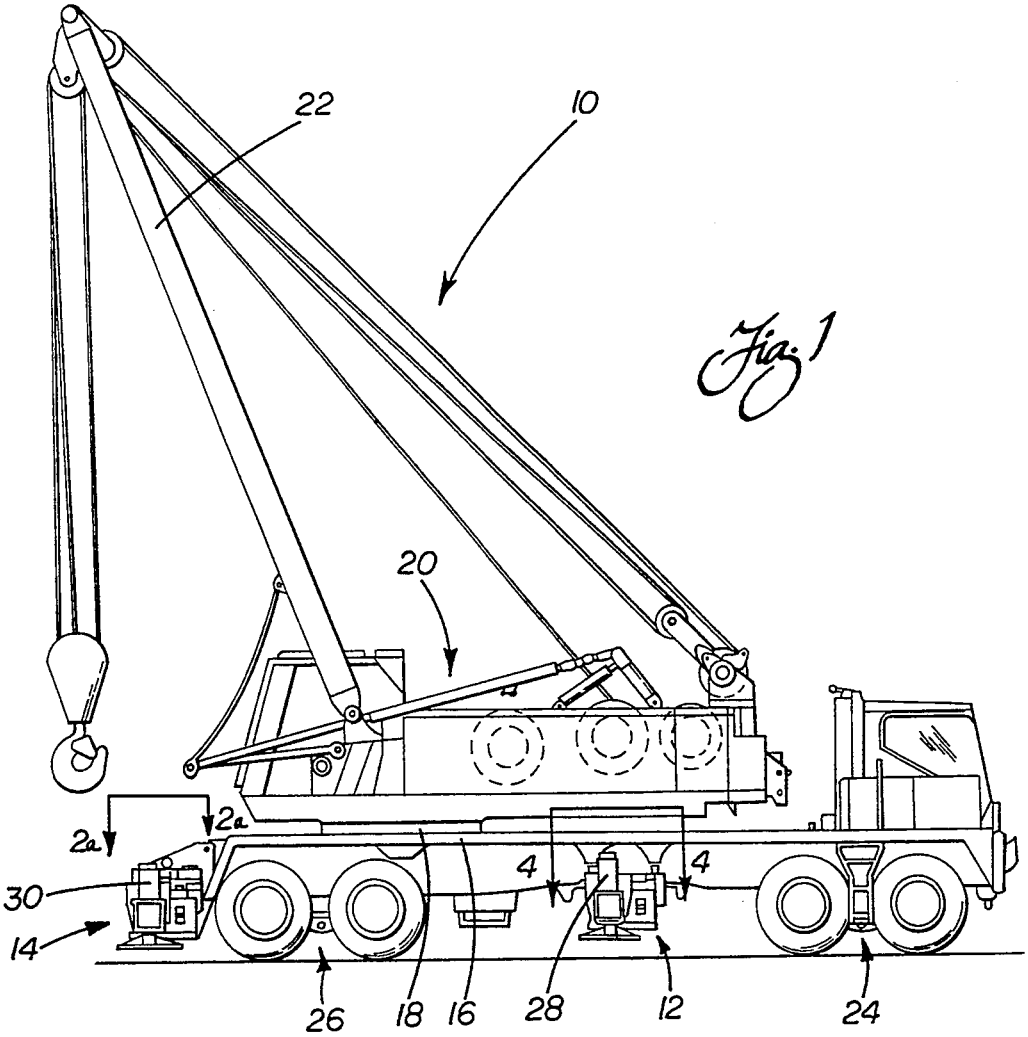
FIG. 1 is an overall side elevational view of a crane vehicle with the live mast raised illustrating locations of front and rear outrigger units of the present invention properly positioned relative to the vehicle.

Reference is now made to FIG. 1 showing a mobile crane vehicle 10 with front outrigger 12 and rear outrigger unit 14 connected to the vehicle frame or chassis 16. As is known in the art, a turntable 18 is also mounted to the frame 16. A crane superstructure 20 of a type known in the art is mounted on the turntable 18 so as to allow rotational movement relative to the frame 16. The live mast 22 of the mobile crane vehicle 10 is shown erected in the operating mode.

As shown, the front outrigger 12 is located between the steerable front wheel assembly 24 and rear wheel assembly 26, and the rear outrigger 14 is located aft of the rear wheel assembly. Both are pinned to the vehicle frame 16 and provide support and stability during use of the crane for lifting. Specifically, when jacking cylinders 28, 30 of the respective front and rear outriggers 12, 14 are actuated to lift the wheel assemblies 24, 26 off the ground, the frame 16 functions as a stable platform from which the crane superstructure 20 may be operated.

One of the advantages of a crane vehicle 10 of the type being described is the ready ability to move over-the-road from job site to job site in a quick and efficient manner. Accordingly, an important aspect of the present invention is the provision of structure allowing both outriggers 12, 14 to be quickly attached and detached from the crane vehicle 10. This allows the outriggers as separate units 12, 14 to be transported detached from the crane vehicle 10 between job sites. Advantageously, this reduces the weight of the crane vehicle 10 thereby allowing the lifting capacity of the cranes to be increased while still complying with road weight restrictions.

This invention includes two preferred embodiments; the first, shown in FIGS. 1–3 corresponding to the rear outrigger 14 and the second, shown in FIGS. 4–17 corresponding to the front outrigger 12.

Figure 2A:
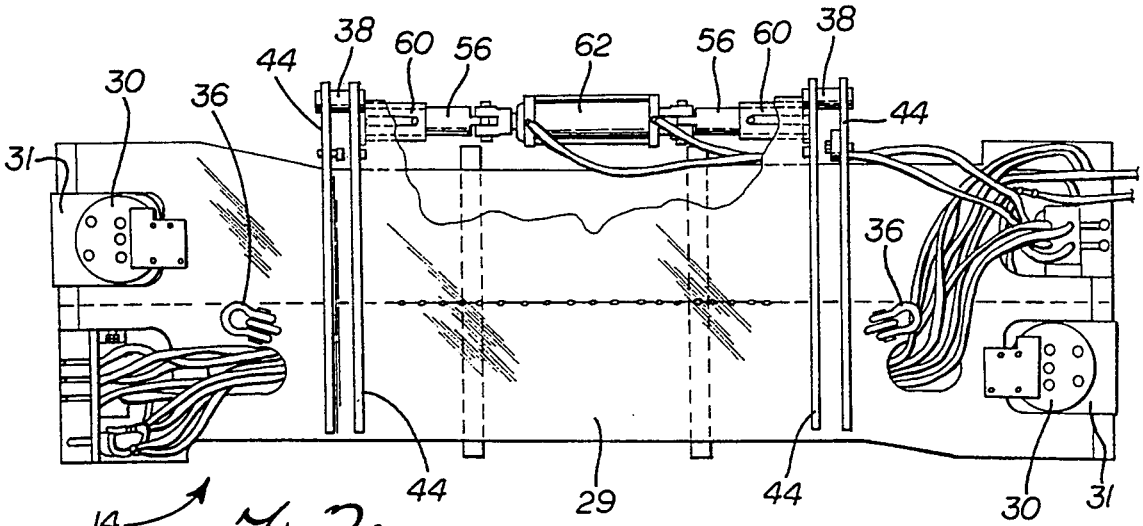
FIG. 2*a* is a top view of the rear outrigger unit with outrigger support beams fully retracted and showing primarily a box frame, hydraulic lock assembly, and the top end of the jacking cylinders.
Figure 2B:
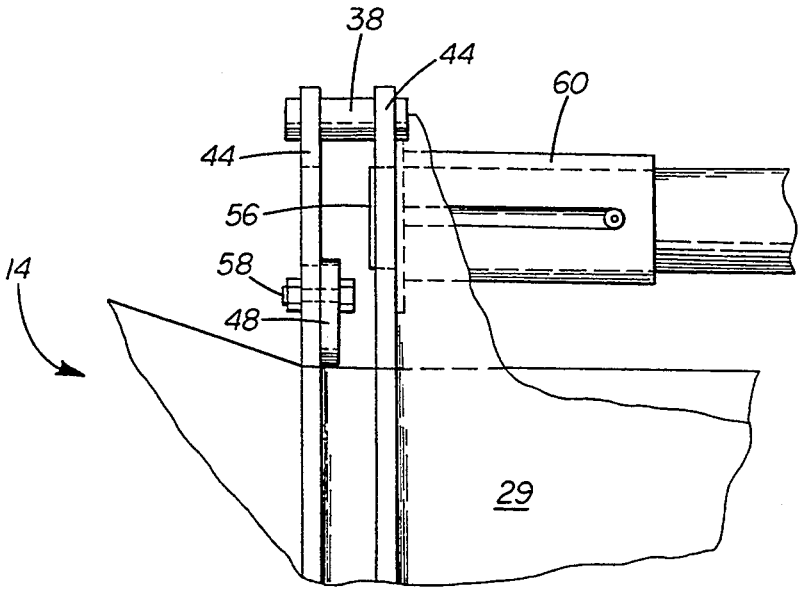
FIG. 2*fb* is a detailed, cut away top view of one of the dual hangers of the rear outrigger unit showing the upper positioned guide pin, as well as the lower adjustable eccentric cam and powered lock pin retracted in its mounting sleeve on the hanger.

As best shown in FIG. 2*a*, the rear outrigger unit 14 includes a box frame 29 that slidably receives opposed, extendable outrigger support beams 31 operated by opposed, internal hydraulic cylinders in a manner known in the art. As shown, the rear jacking cylinders 30 are directly mounted to the distal ends of these support beams 31.

Figure 3A:
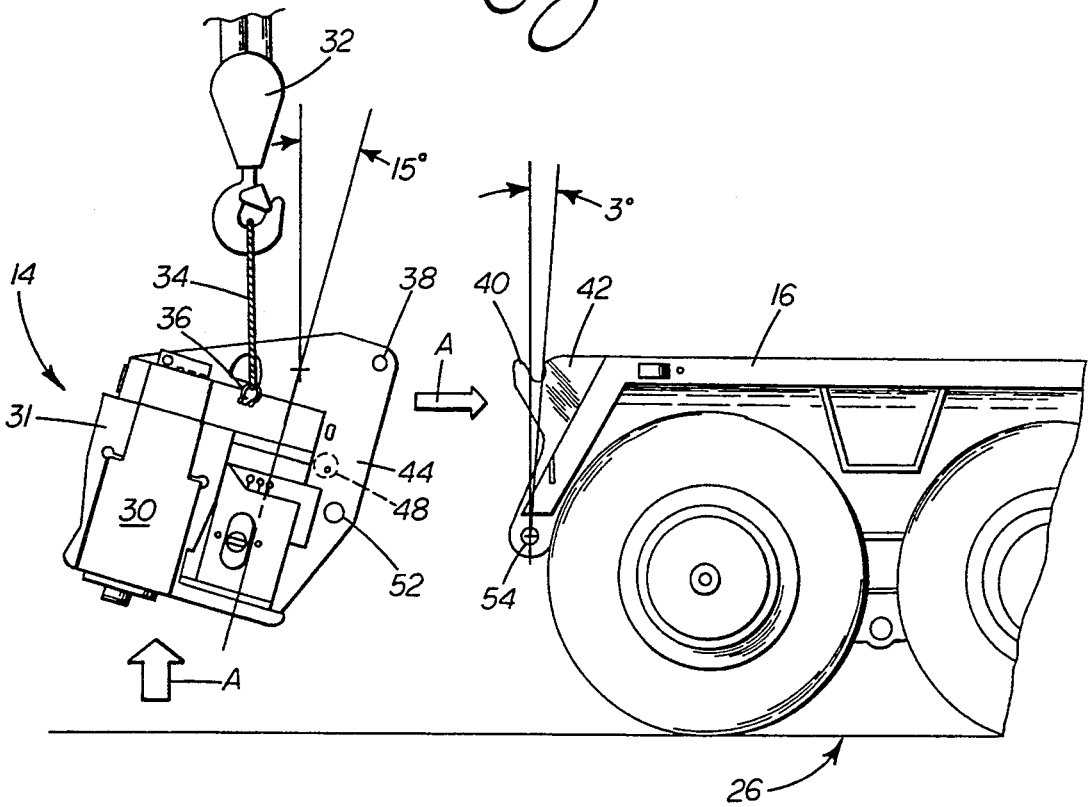

FIG. 3*a* shows the rear outrigger unit 14 as it is handled near the vehicle frame 16 by the crane through means of a sling 34. As shown and described in greater detail below, the crane's live mast 22 is used to lift the outrigger unit 14 using off-center shackles 36 to move it into position on spaced, vertical mounting lugs 42 on the vehicle frame 16 (note action arrows A). Specifically, guide pins 38 engage open hooks 40 on the lugs 42 extending vertically along the rear of the frame 16. As shown, each guide pin 38 is secured in and bridges a cooperating pair of mounting hangers 44 fixed to the box frame 29.

The outrigger unit 14 is suspended slightly cocked at an angle of 15° to vertical when lifted from its off center shackles 36. Thus, when the outrigger 14 is lowered so the guide pins 38 engage the hooks 40, the outrigger pivots under gravity about the guide pins (note sequence action arrows B and C in FIG. 3*b*). Specifically, the outrigger 14 pivots until rotary eccentric cams 48 mounted between the hangers 44 contact a positioning stop points 50 on the lower section of the lugs 42. Advantageously, the position of the rotary eccentric cams 48 is preadjusted to insure that when engagement at the positioning stop point 50 occurs, apertures 52, 54 in the hangers 44 and the lugs 42, respectively, are aligned for the receipt of dual lock pins 56.

A 3° angle between vertical and the line connecting the centers of the hooks 40 and lock pin apertures 54 (see FIG. 3*a*) insures that sufficient gravitational force is present to rotate the outrigger 14 about pivot guide pins 38 into the proper position (see FIG. 3*c*). The 15° tilt of the rear outrigger unit 14 when raised, provides the preferred positioning to insure easy initial engagement.

The preadjustment of the rotary eccentric cams 48 is initially completed by the manufacturer and under normal circumstances does not need readjustment for a reasonably long service life. However, due to normal wear of the parts, or minor deformation, due to the point contact of the face edges of the lugs 42 and the cam 48, some readjustment by the operator may be necessary. Specifically, the locking bolt 58 holding each cam 48 in position is loosened; and then the cams are rotated (see FIG. 2*b*) until proper engagement is assured. The bolts 58 are then tightened to lock the cams 48 in position where they can insure subsequent proper alignment.

Figure 3E:
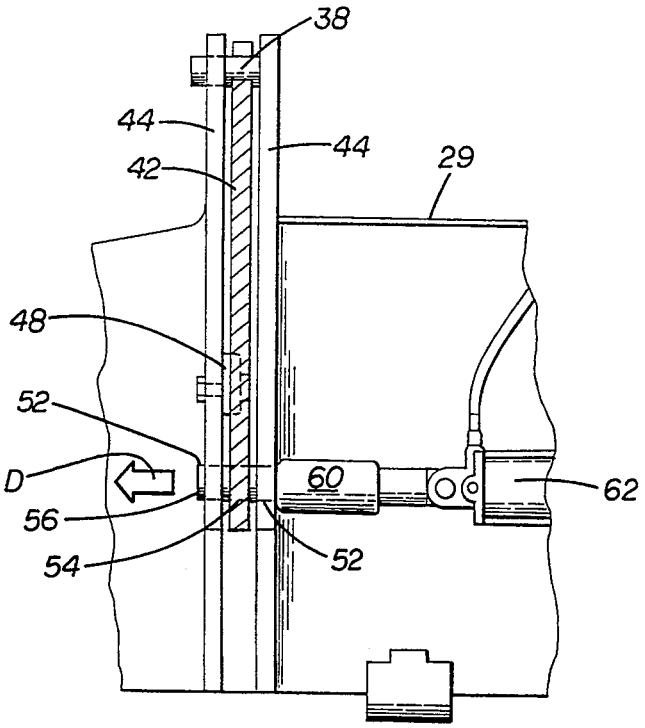
FIG. 3*e* is a more detailed rear view, generally corresponding to the showing in FIG. 3*d*, and illustrating more fully the lock pin insertion through the aligned apertures in the dual hangers of the outrigger unit and the vertical lug on the vehicle frame.
Figure 4:
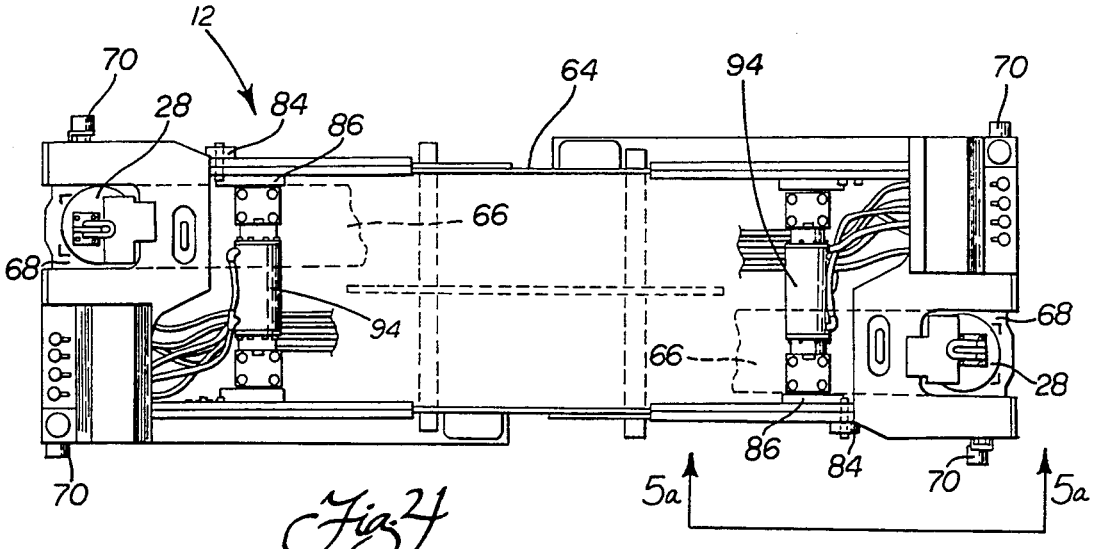
FIG. 4 is a detailed top view of the front outrigger unit with the outrigger support beams retracted and also showing the box frame, the top of the jacking cylinders, hydraulic lock assemblies, adjustable eccentric cams and support rollers.
Figure 5A:
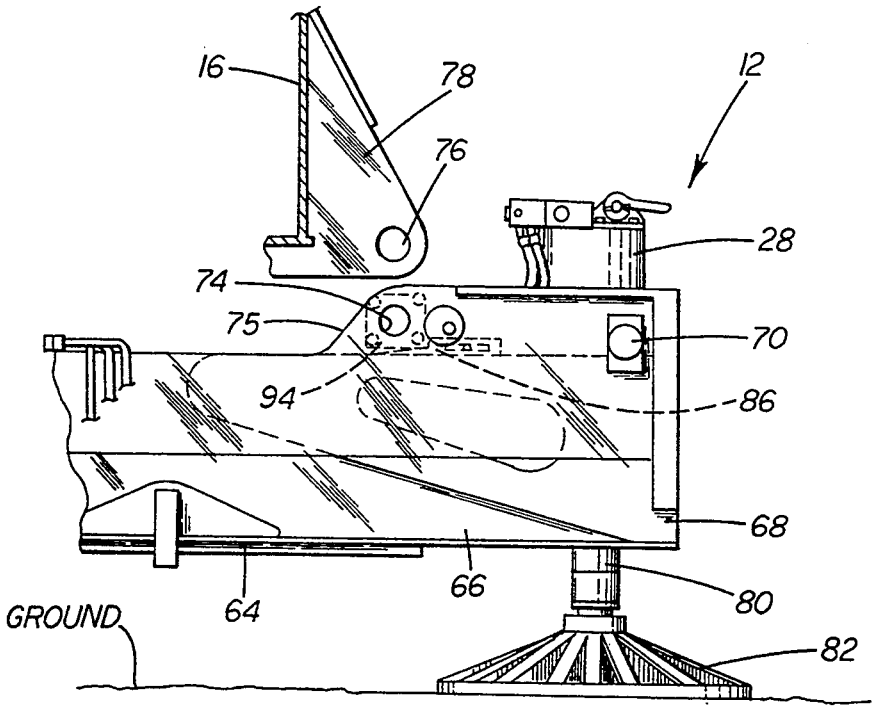
FIGS. 5*a* and 5*b* are detailed rear elevational views of the right end (vehicle right side) of the front outrigger unit, taken in the direction of line 5*a*—5*a*of FIG. 4, showing in sequence the alignment procedure effected when the unit is lifted and the eccentric cams and linear cams engage with point contact the mounting lugs on the vehicle frame.
Figure 5B:
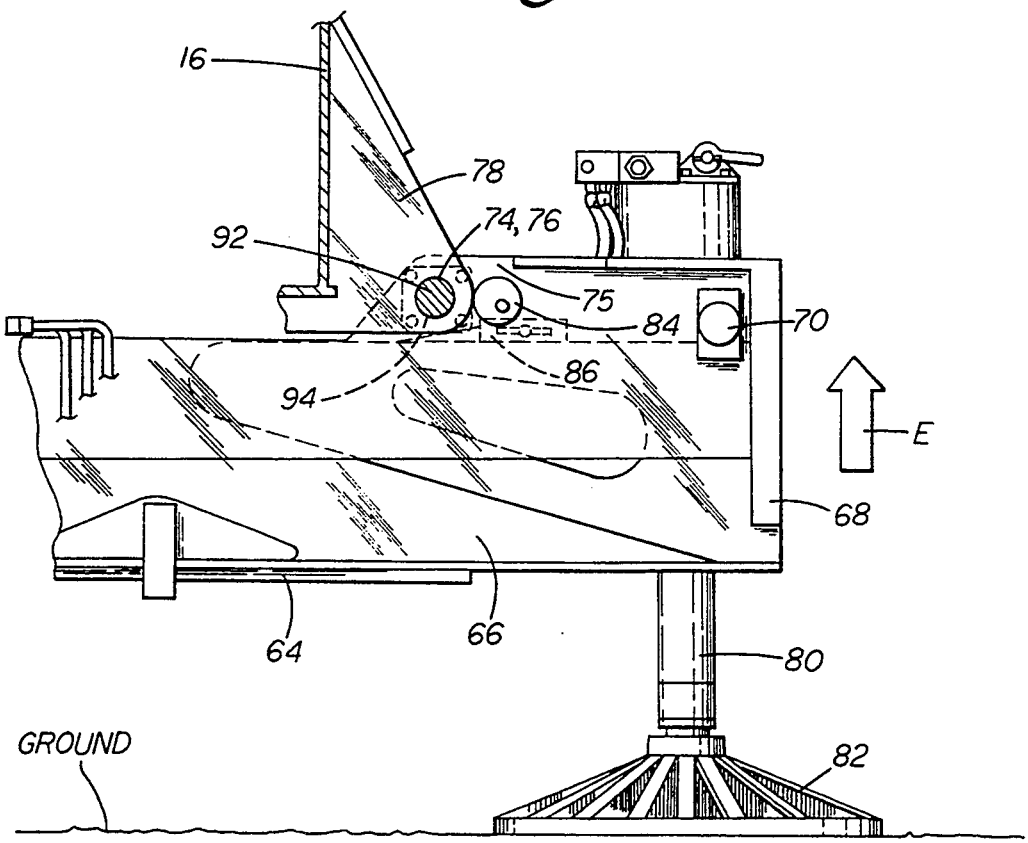
Figure 8:
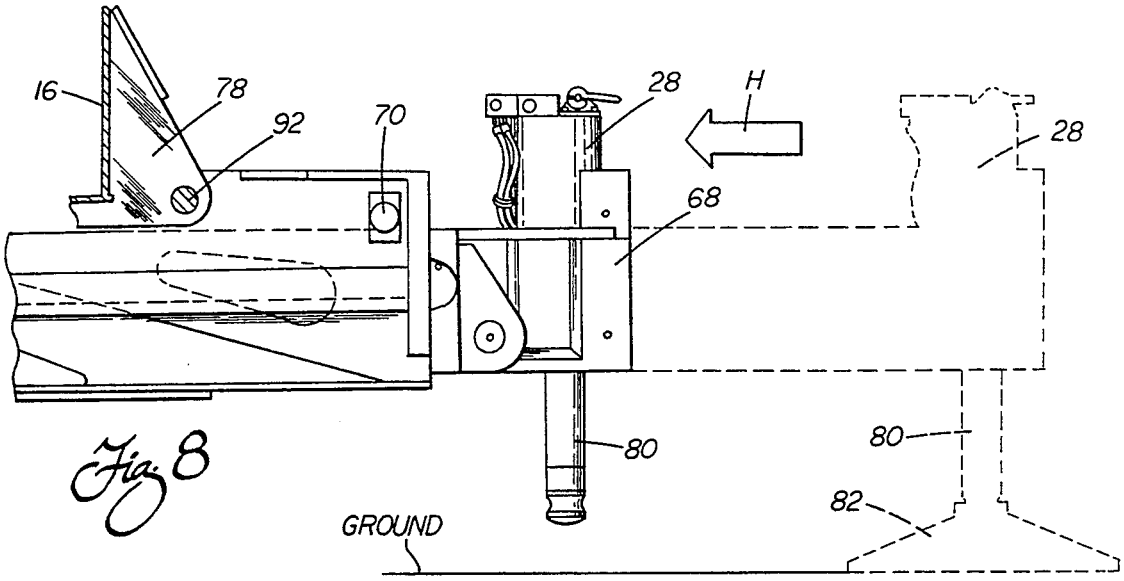
FIG. 8 is a detailed front view of the left end (vehicle left side) of the front outrigger unit showing the outrigger beam partially retracted, and the ground engaging pad removed (the beam being shown fully extended with pad attached in the ground support position in phantom lines)
Figure 9:
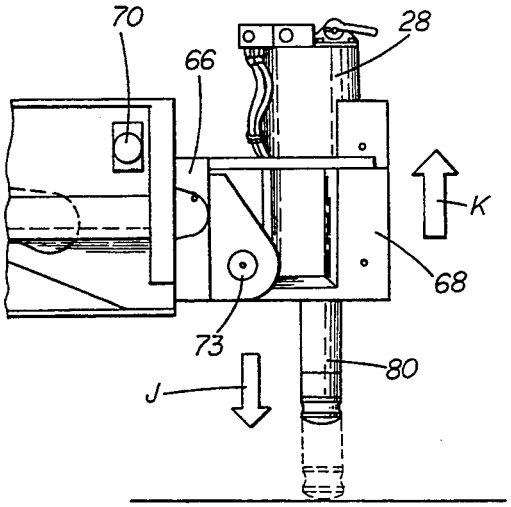
FIG. 9 is a detailed view of the left end (as in FIG. 8) illustrating actuation of the jacking cylinder.

As shown best in FIGS. 3*d* and 3*e*, the entire lock pin assembly, including the lock pins 56 are supported on the outrigger unit 14; the pins being guided by sleeves 60 that are connected to the inner one of each of the dual hangers 44. A double acting hydraulic cylinder 62 mounted to the outrigger 14 propels the lock pins 56 axially outward through the aligned apertures 52, 54 in the directions shown by action arrows D to complete the secure attachment.

The second preferred embodiment of the present invention is the front outrigger unit 12 with alignment provisions similar to the rear outrigger unit 14. As shown generally in FIG. 4, a box frame 64 slidably receives opposed, extendable support beams 66 with end beam extensions 68 to which are mounted the front jacking cylinders 28 (see also FIGS. 14 and 15). This embodiment also provides improved means for positioning/removal of the outrigger 12 from under the vehicle frame 16.

Figure 17:
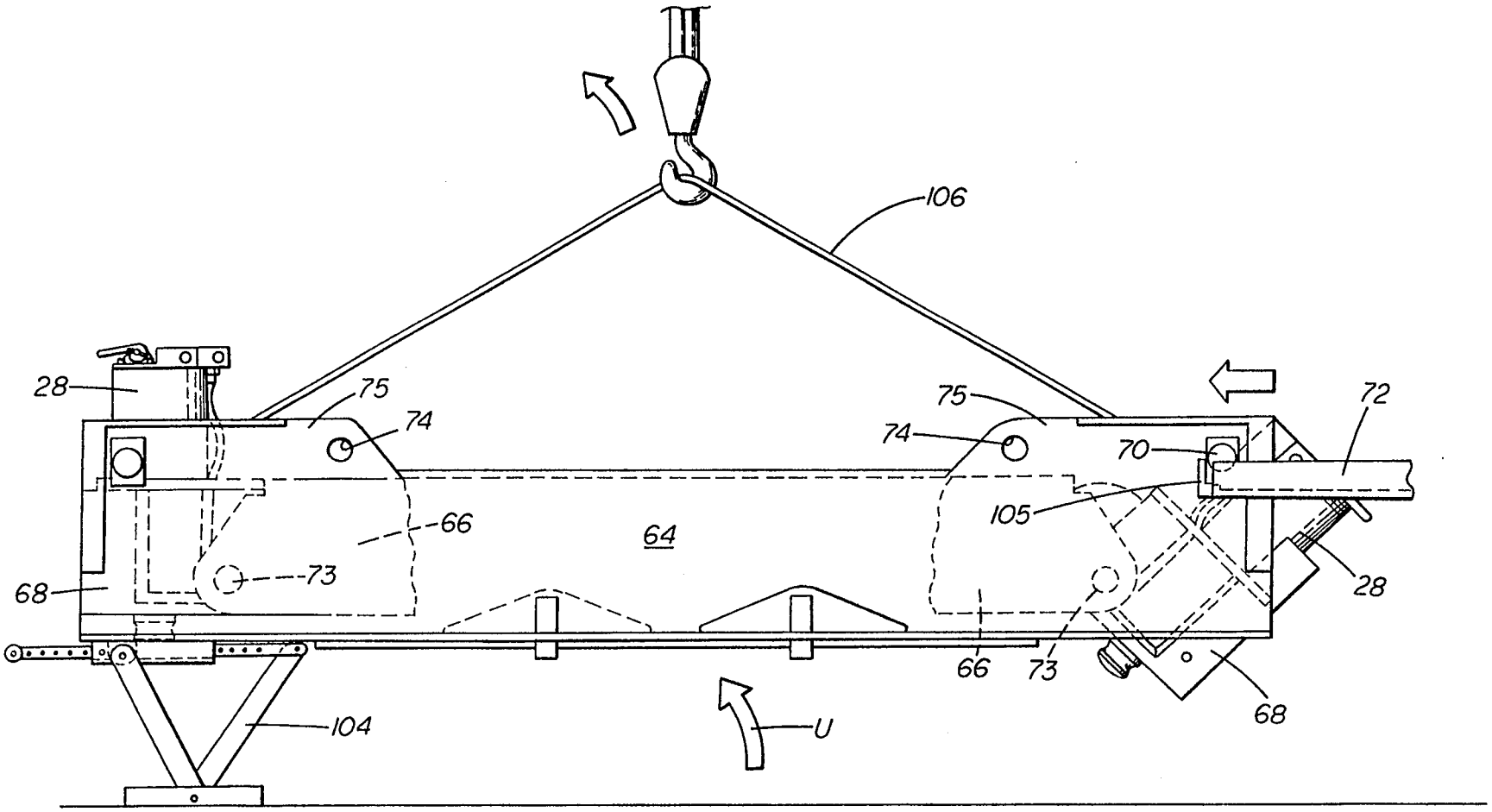
FIG. 17 is a front view of the front outrigger unit when removed from under the vehicle frame with the sling attached and being raised by the crane for positioning on a low boy trailer (not shown) for separate transport.

Initial attachment of the front outrigger unit 12 to the vehicle frame 16 is more complex because it is positioned and attached to the underside of the vehicle frame rather than the back. Outboard support rollers 70 on the outrigger 12 roll along tracks 72 on the vehicle frame 16 to facilitate positioning of the outrigger, and partially alleviate this problem (see FIGS. 4 and 7). Specifically, with the left side (vehicle left side) beam extension 68 and the jacking cylinder 28 tilted on pivot pin 73 of a mounting trunnion, as shown in FIGS. 12 and 17, the outrigger unit 12 is laterally shifted with respect to the frame 16 on the track 72 until the lead rollers 70 engage the track. Motive power for the shifting movement to bring the outrigger unit fully under the crane is provided by reversing the two stroke, walking method in a manner that will become more apparent from the following description.

Figure 11:
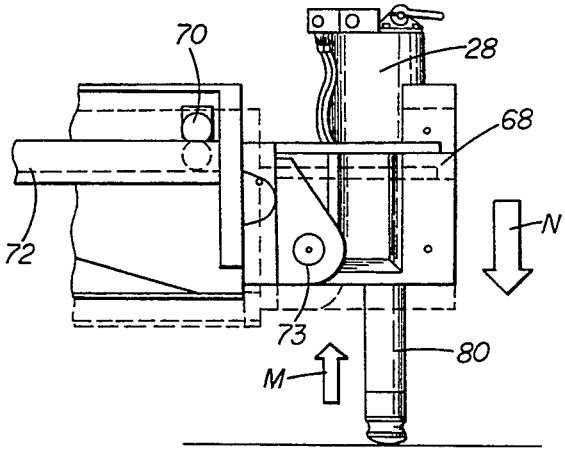
FIG. 11 shows retraction of the jacking cylinder to lower the outrigger unit so as to be supported on its rollers resting upon lateral frame rails.
Figure 11A:
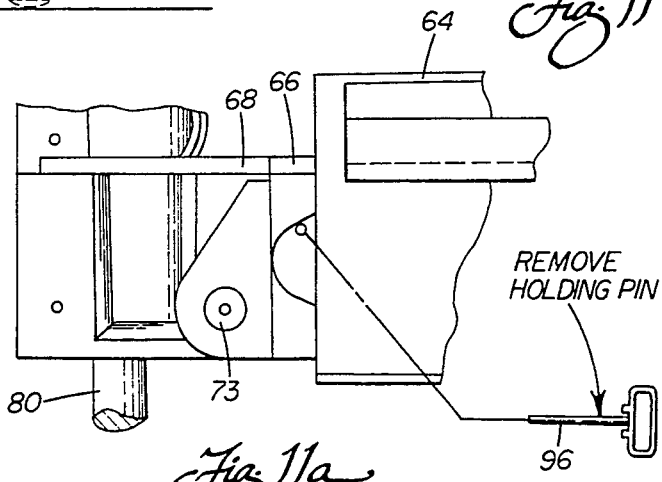
FIG. 11*a* is an enlarged rear view showing the offset pivot mounting of the cylinder in more detail, and the manner of removal of the holding pin to allow pivotal movement of the outrigger support beam extension to tilt the jacking cylinder.
Figure 10:
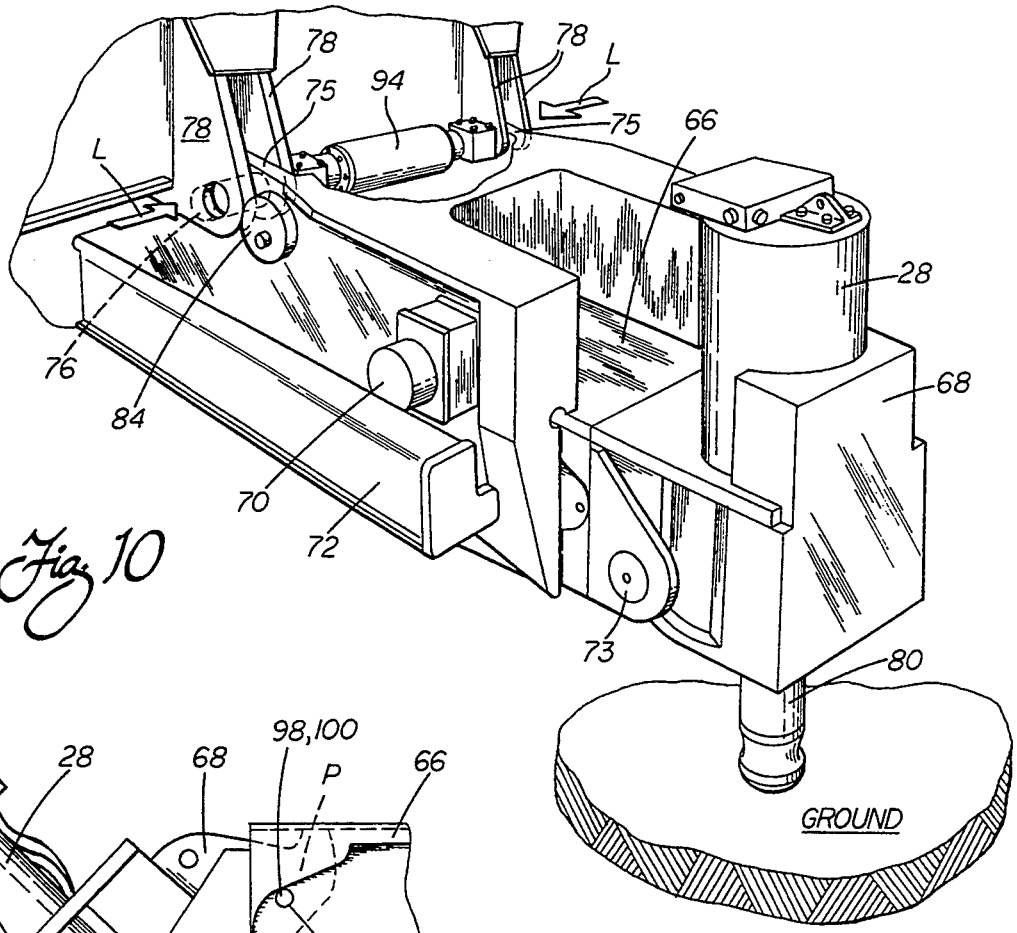
FIG. 10 is a perspective view from the front of the left end of the front outrigger unit illustrating raising of the unit to unload and allow retraction of the lock pins.
Figure 12A:
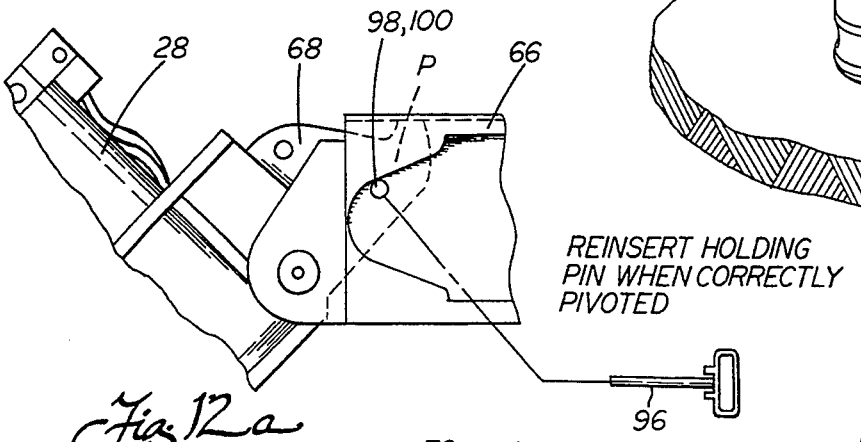
FIG. 12*a* is a rear view showing reinsertion of the holding pin to secure the beam extension in the tilted position.
Figure 12:
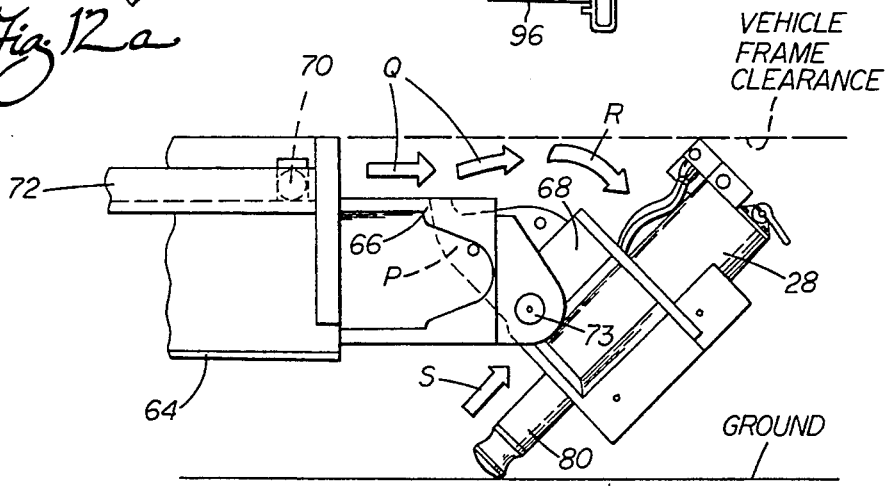
FIG. 12 is a front view showing the self-powered action of the left jacking cylinder of the front outrigger unit as the beam extension is lifted, extended and tilted to provide frame clearance for the cylinder.
Figure 14:
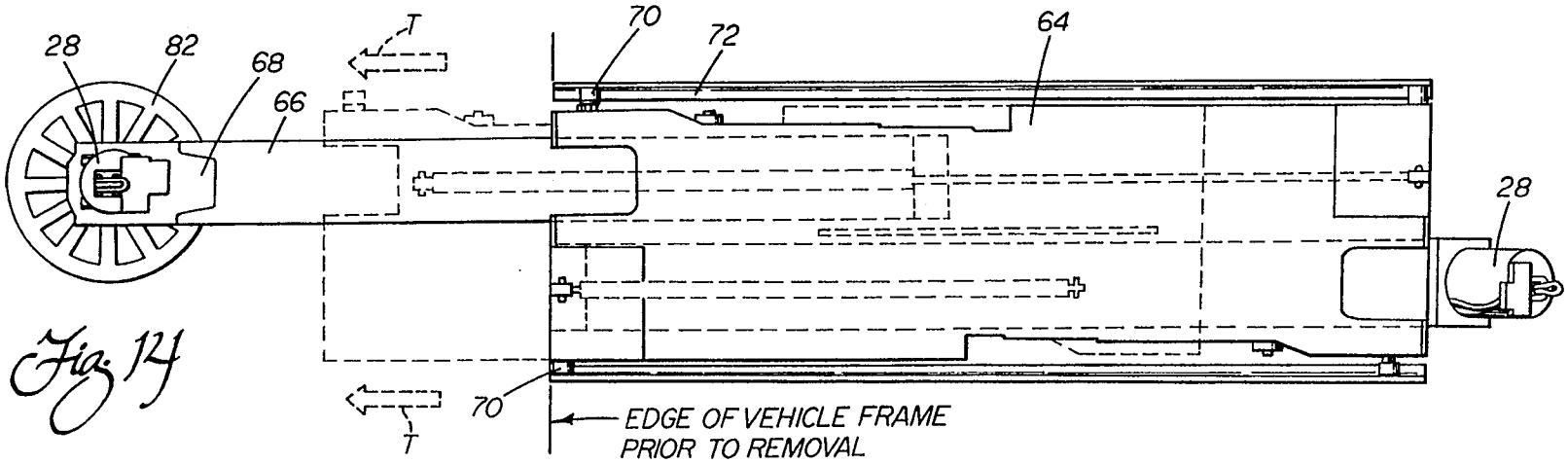
FIGS. 14 and 15 are overall plan views of the front outrigger unit showing the two stroke, walking method for self-powered removal from under the vehicle frame, or by reverse, positioning the unit under the frame.
Figure 15:
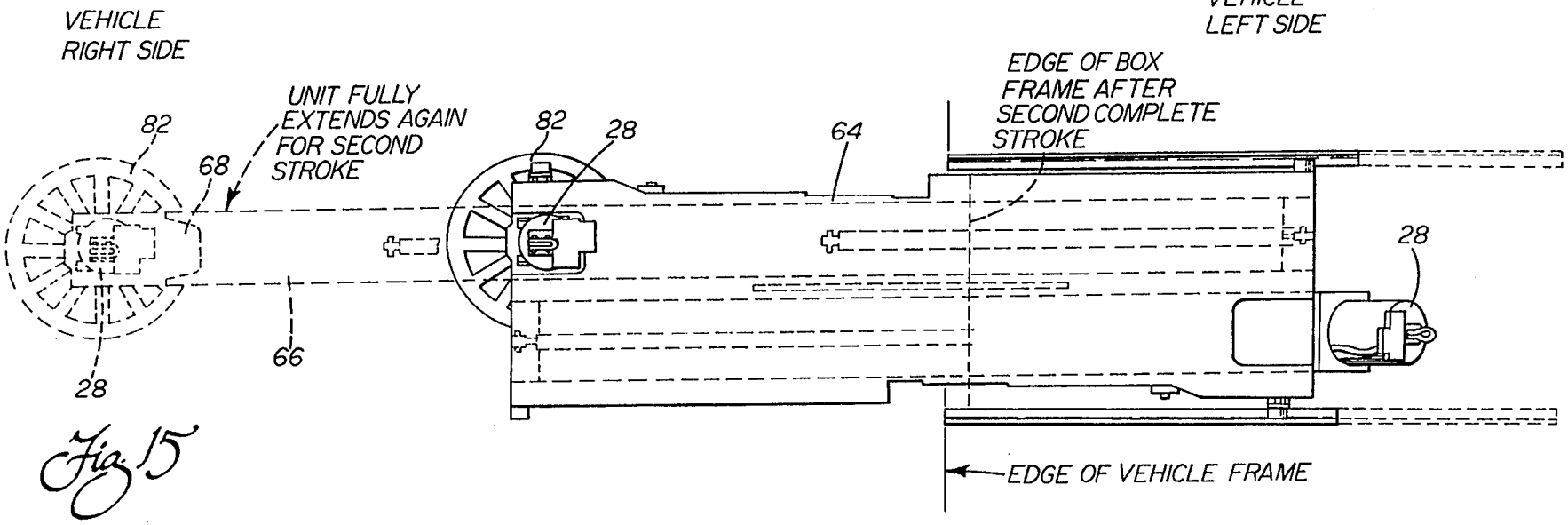

Once the outrigger 12 is in proper position under the vehicle frame 16, the tilted beam extension 68 is unpinned, pivoted on pin 73 to its vertical orientation and repinned (note pin 96 shown in FIGS. 11*a*, 12*a*). The pad 82 is then reinstalled on the piston rod 80 of the now upright jacking cylinder 28.

The front outrigger unit 12 is then aligned for securement with the vehicle frame 16 in a manner similar to the rear outrigger unit 14. However, in this case, the jacking cylinders 28 are actuated to lift the outrigger unit. Lock pin receiving apertures 74 in mounting ears 75 on the box frame 64 are aligned with corresponding apertures 76 in the dual mounting lugs 78 attached to the side of the vehicle frame 16 (see FIGS. 5*a* and 5*b*). The preadjusted rotary eccentric cams 84 carried on the ears 75 of the outrigger box frame 64 are brought into engagement with the side edge face of one of the dual lugs 78 on the frame 16 (see FIG. 5*c*). This engagement causes the outrigger 12 to shift laterally as required to bring about horizontal alignment of apertures 74, 76. Smooth shifting motion is insured by the curved profiles of the cams 84 and edge face of the lug 78. In addition, preadjusted linear cams 86 are simultaneously brought into engagement with the bottom edge face of the other one of the lugs 78 to vertically align the apertures 74, 76 (see FIGS. 5*b* and 5*c* ).

Specifically, adjustment of the rotary eccentric cam 84 is made by first loosening locking bolt 88 and rotating and relocking it as shown in FIG. 6. Similarly, adjustment of the linear cam 86 is made by first loosening the locking bolt 90, shifting the cam 86 utilizing slot 87, and then relocking the bolt (note action arrow F in FIG. 5*c*). When the bolts 88, 90 are tightened down to lock the cams 84, 86 in position, they stop against the edge faces and provide very efficient mechanical action alignment of the lock pin receiving apertures 74, 76 and without manual manipulation.

The lock pins 92 are inserted into the aligned apertures 74, 76 by actuation of double acting cylinder 94 that push the pins axially outward, as depicted by action arrows G in FIG. 7 (see also FIG. 5*d*). Advantageously, the entire hydraulic lock assembly is carried on the outrigger unit 12, in the same manner as with the rear outrigger unit 14, and so as to minimize the weight left on the crane vehicle 10. The lock pins 92 hold the front outrigger unit 12 securely to the vehicle frame 16. The ears 75 are positioned between the mounting lugs 78 and the cams 84, 86 are on opposite sides in order to further assist in the alignment and securing operation. The outrigger unit 12 can now be fully suspended from the frame 16 by actuating the jacking cylinders to retract the cylinders 28 and lift the pads 82 from the ground.

The crane vehicle 10 is now ready to move into any operative position within the confines of the job site. The opposed sets of outrigger support beams 31, 66 are then both fully deployed by being extended outwardly by the internal cylinders. Usually the operator chooses the maximum extension for the greatest supporting configuration. The jacking cylinders 28, 30 are actuated to lower the pads 82 so as to engage the ground in the extended position. The cylinders 28, 30 serve to lift the vehicle wheel units 24, 26 off the ground to provide the stable platform ready for crane operation.

Following crane operation at the current job site, the crane vehicle 10 then must travel over-the-road to move to the next job site, or to return to the operator's facilities. To do so, and in accordance with the present invention, the outrigger units 12, 14 are now removed to bring the crane vehicle 10 into compliance with load limit restrictions.

The removal of the front outrigger 12 is a multiple step procedure demonstrating important advantages of this embodiment. First, the jacking cylinders 28 are actuated so that the piston rods 80 are partially retracted; the vehicle now resting on the front wheel assembly 24, and on either the rear outrigger unit 14 or the wheel assembly 26. The support beams 66 are also retracted through about ⅔ of full stroke, as shown by action arrow H in FIG. 8. Next, the pad 82 is removed from the left side cylinder 28 (see FIG. 8). The rods 80 of the jacking cylinders 28 are then re-extended to lift the outrigger 12 and just relieve loading on the locking pins 92 (see also FIG. 9, and action arrows J and K respectively). This allows retraction of all four of the locking pins 92 from the apertures 74, 76, as depicted by action arrows L in FIG. 10, by actuating both double acting hydraulic cylinders 94. The rods 80 are now additionally retracted into jacking cylinders 28 to lower the outrigger 12 relative to the frame 16 until the rollers 70 are resting on tracks 72 (see action arrows M and N respectively in FIG. 11).

At this point the holding pin 96, securing the left beam extension 68 to its support beam 66 is removed (see FIG. 11*a*). As a result, the only remaining connection of the beam extension 68 to the support beam 66 is then the pivot pin 73. It will be remembered that the pivot pin 73 is mounted on the extension 68 offset from longitudinal axis and adjacent the lower end of the cylinder 28. This arrangement allows the left beam extension 68, and the jacking cylinder 28 mounted thereon, to be tilted to provide clearance for passage under the vehicle frame 16.

Specifically, the cylinder 28 is actuated so that the rod 80 engages the ground. Next, the support beam 66 and/or the cylinder 28 are actuated to extend outwardly in concert, so that the beam moves out and up (see action arrows Q in FIG. 12) and the beam extension 68 is caused to tilt (see action arrow R) so as to provide the frame clearance desired. When fully pivoted, the upper edge face of an inboard stop arm on the extension 68 engages the inside support beam 66 at point P. The holding pin 96 is then re-inserted through aligned apertures 98, 100 in the support beam 66 and beam extension 68, respectively. In this position, the pin 96 secures the jacking cylinder 28 in the tilted position (FIG. 12*a*). The rod 80 of the now tilted left side jacking cylinder 28 is then retracted to provide clearance with the ground and the left side beam 66 is fully retracted into the box frame 64.

The right side support beam 66 is now fully extended from the box frame 64. The rod 80 of the right side jacking cylinder 28 is next extended to engage and seat the pad 82 on the ground, and to lift the beam 66 slightly so that the end stop of the track 72 can be cleared by the right side rollers 70. This procedure results in fixing the position of the right side support beam 66 ready for the removal of the unit by the walking type action, now to be described (see FIG. 16).

The internal beam hydraulic cylinder (see FIGS. 14, 15 and the phantom line outline thereof) is then actuated as if to retract the right side support beam 66. Because the support beam 66 is fixed in position by the pad 82 relative to the ground (staking or other means may be used if necessary to assure that the pad 82 remains stationary), the box frame 64 is instead actually moved toward the end of the beam and partially out from under the vehicle frame 16 (see action arrows T in FIGS. 14, 15, 16).

Once the internal beam cylinder is fully retracted, a scissor jack stand 104 (mounted under the box frame 64 adjacent the right side end) is lowered to support the weight thereof (see FIGS. 13 and 13*a*). The rod 80 and pad 82 are raised from the ground by operation of the jacking cylinder 28, and the right side support beam 66 is then reextended (see FIG. 16). Next, the jacking cylinder 28 is actuated to again lower the pad 82 into engagement with the ground thereby fixing its position. The beam cylinder is actuated to pull the box frame 64 the rest of the way out from under the frame 16.

The scissor jack stand 104 once again is used to provide support of the end of the beam 66 so that the pad 82 may be removed as the cylinder 28 is actuated and the rod 80 is raised. The left end of the box frame 64 remains supported by the trailing, left side rollers 70 on the track 72 against its end stops 105 (see FIG. 17). The outrigger 12 is then ready to be lifted and removed for placement on a flatbed truck for transport using the crane and sling assembly 106 (FIG. 17 and action arrow U).

As mentioned above, the outrigger unit 12 is reinstalled under the frame 16 in a similar manner by reversal of these steps. The same advantage of utilizing only self-power, and thus eliminating the need for substantial manual manipulation as in the prior art methods is realized.

Of course, the rear outrigger unit 14 is simpler to remove. First, the crane supported cable sling 34 is attached to the off-center shackles 36. Next, the pins 56 are retracted from the aligned apertures 52, 54 in the cooperating hangers 44 and the lugs 42. The outrigger unit 14 is now free to be lifted for placement on a flat bed truck for subsequent over-the-road transport. As illustrated in FIG. 3*b*, during lifting the unit 14 first pivots away from the mounting lugs 42 (opposite arrow C) and then up and out (opposite arrow B). In this manner, free and easy disengagement is assured.

In summary, an improved handling system for easily, quickly, and efficiently attaching and removing front and rear outrigger units 12, 14 to and from a crane vehicle 10 is evident. Eliminating manual manipulation for the alignment of apertures 52, 54 and 74, 76 to receive the respective lock pins 56, 92 greatly accelerates the required procedure, and eliminates the need for a two or three man crew to assist in removal and reattachment of the units 12, 14. A key feature of this portion of the invention is the provision of preadjusted rotary cams 48, 84, and linear cam 86 on the outrigger units 12, 14. These function as point contact guide elements to automatically align the apertures as the units are simply lifted into position in engagement with the mounting lugs 42, 44 on the frame 16. Hydraulic lock assemblies including cylinders 62, 94 are mounted on the rear outrigger 14 and front outrigger 12, respectively, and they move the lock pins 56, 92 through the aligned apertures. Since the assemblies can be removed with the units, the effective capacity of the crane vehicle 10 is maximized considering the over-the-road weight limits. The extra weight can then be incorporated into the reinforcing structure of the vehicle for greater capacity. The front outrigger unit 12 further includes structure, including an offset, pivoting beam extension 68, providing a way for self-powering the tilting of the cylinder 28 and removal of the entire unit from under the vehicle frame 16. The removal method, which is simply reversed for reinstallation, takes advantage of alternately extending one of the support beams 66 and pulling the box frame 64 to the beam, in an efficient walking fashion.

The foregoing description of two preferred embodiments of the invention has been presented for purposes of illustration and description. It is not intended to be exhaustive or to limit the invention to the precise form disclosed. Obvious modifications or variations are possible in light of the above teachings. For example, since both cylinders 28 of the front outrigger unit 12 are mounted by pivot beam extensions 68 in the preferred embodiment, removal and reinstallation can be effected from either side. The reference to right and left side operation above, is simply for ease of description. The embodiments were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A removable outrigger for attachment to a crane vehicle frame comprising:

a box frame;

means for securing said outrigger to said vehicle frame;

at least one support beam extendable from said box frame;

a beam extension on said support beam;

pivot means for connecting said beam extension to said support beam;

a vertically oriented jacking cylinder connected to said beam extension;

the center axis of said jacking cylinder being spaced outwardly from said pivot means, and said pivot means being located adjacent the lower end of said cylinder; and means for releasably securing the pivotal connection of said beam extension relative to said support beam, whereby actuation of said jacking cylinder and extension of said support beam during disengagement of said securing means effects self-powered tilting movement of said beam extension and said jacking means to allow clearance under said vehicle frame.

2. The assembly of claim 1 wherein said securing means includes a holding pin engaging in aligned apertures in said beam extension and said support beam.

3. The assembly of claim 1, further including stop means for limiting the tilting movement of said beam extension on said support beam.

4. A method of removing an outrigger from under a frame of a mobile crane vehicle frame positioned on the ground, said outrigger including a box frame, a first extendable support beam including a first jacking means and a second, opposing and extendable support beam including a second jacking means, said method comprising the steps of:

(1) tilting and retracting said first jacking means for clearance under said vehicle frame;

(2) extending said second support beam outwardly from said box frame by operation of a hydraulic cylinder;

(3) extending said second jacking means to engage the ground, thereby fixing its location;

(4) retracting said hydraulic cylinder to pull said box frame toward said second jacking means;

(5) maintaining said box frame in position above the ground;

(6) repeating steps 2–5 to cause said outrigger to substantially clear said vehicle frame; and (7) lifting said outrigger for separate transport, whereby over-the-road weight of the crane vehicle is minimized.

5. A removable outrigger for attachment to a crane vehicle frame comprising:

a box frame with extendable support beams;

means for securing said box frame to said vehicle frame;

cam means for proper horizontal alignment of said outrigger during movement into engagement with said vehicle frame, said cam means including at least a pair of spaced rotary eccentric cams;

means of preadjusting said rotary eccentric cams for selected point contact with mounting lugs on said vehicle frame to effect said proper horizontal alignment; and hangers for supporting guide pins and connected to said box frame, said mounting lugs having open hooks on said vehicle frame, said guide pins being received in said hooks to provide proper vertical alignment of said outrigger with said vehicle frame;

whereby said securing means can be implemented without manual manipulation of said outrigger to assure rapid attachment and removal.

6. The assembly of claim 5, wherein off-center lifting lugs are provided to cause an approximate 15° tilting of said outrigger during positioning on said mounting lugs, and said mounting lugs extend at an approximate 3° tilt between said point of contact of said cams and said open hooks, whereby angled positioning of said outrigger and cam contact with respect to said lugs is assured.

7. The assembly of claim 6, wherein off-center lifting lugs are provided to cause an approximate 15° tilting of said outrigger during positioning on said lugs, and said lugs extend at an approximate 3° tilt between said point of contact of said cams and said open hook, whereby angled positioning of said outrigger and cam contact with respect to said lugs is assured.

8. A removable outrigger for attachment to a crane vehicle frame comprising:

a box frame with extendable support beams;

means for securing said box frame to said vehicle frame;

cam means for proper horizontal alignment of said outrigger during movement into engagement with said vehicle frame, said cam means including at least a pair of spaced rotary eccentric cams;

means of preadjusting said rotary eccentric cams for selected point contact with mounting lugs on said vehicle frame to effect said proper horizontal alignment; and said securing means includes lock pins engaging aligned apertures in said box frame and said lugs, and power means to operate said pins, whereby said securing means can be implemented without manual manipulation of said outrigger to assure rapid attachment and removal.

9. The assembly of claim 8 wherein said power means includes a double acting hydraulic cylinder to actuate said lock pins to move in opposite directions to engage said apertures, said hydraulic cylinder and lock pins being mounted on said outrigger to allow maximum crane capacity considering over-the-road operation restrictions.

10. A removable outrigger for attachment to a crane vehicle frame comprising:

a box frame with extendable support beams;

means for securing said box frame to said vehicle frame;

cam means for alignment of said outrigger with the vehicle frame prior to being secured, said cam means including a pair of linear cams for effecting proper vertical alignment;

means for preadjusting said linear cams to effect said proper alignment, a pair of dual mounting lugs on said vehicle frame, ear means mounted on said box frame, said securing means including lock pins engaging aligned apertures in said dual lugs and said mounting ear means, and power means for actuating said pins to engage said apertures, whereby said securing means can be implemented without manual manipulation of said box frame to assure rapid attachment and removal.

11. The assembly of claim 10, wherein said dual mounting lugs extend on opposite sides of said ear means and said cam means including a rotary cam and a linear cam positioned on opposite sides of said ear means to engage the edge faces of said lugs for horizontal and vertical alignment, respectively, and so as to provide secure engagement during installation of said outrigger on said vehicle frame.

12. The assembly of claim 11, wherein said securing means includes lock pins engaging aligned apertures in said vehicle frame and said box frame, a double acting hydraulic cylinder to actuate said lock pins to move in opposite directions to engage said apertures, said hydraulic cylinder and lock pins being mounted on said outrigger to allow maximum crane capacity considering over-the-road operation restrictions.

13. The assembly of claim 10, wherein said cam means further includes spaced, rotary eccentric cams for effecting the horizontal alignment of said outrigger with said vehicle frame.

14. The assembly of claim 13 further including means for rotating said rotary eccentric cams about fixed axes, and means for locking said rotary eccentric and linear cams in proper position.

15. The assembly of claim 14, wherein said locking means include locking bolts.

* * * * *